US006568785B1

(12) United States Patent
Edelen et al.

(10) Patent No.: US 6,568,785 B1
(45) Date of Patent: May 27, 2003

(54) INTEGRATED INK JET PRINT HEAD IDENTIFICATION SYSTEM

(75) Inventors: John Glenn Edelen, Versailles, KY (US); George Keith Parish, Winchester, KY (US); Kristi Maggard Rowe, Richmond, KY (US)

(73) Assignee: Lexmark International, Inc, Lexington, KY (US)

( * ) Notice: Subject to any disclaimer, the term of this patent is extended or adjusted under 35 U.S.C. 154(b) by 0 days.

(21) Appl. No.: 10/100,350

(22) Filed: Mar. 18, 2002

(51) Int. Cl.[7] ..... B41J 29/393
(52) U.S. Cl. ..... 347/19; 400/175
(58) Field of Search ..... 347/19; 399/12; 400/175

(56) References Cited

U.S. PATENT DOCUMENTS

| | | | | |
|---|---|---|---|---|
| 4,872,027 A | | 10/1989 | Buskirk et al. | |
| 4,930,915 A | | 6/1990 | Kikuchi et al. | |
| 5,033,887 A | | 7/1991 | Bauerle | |
| 5,049,898 A | | 9/1991 | Arthur et al. | |
| 5,049,904 A | | 9/1991 | Nakamura et al. | |
| 5,363,134 A | | 11/1994 | Barbehenn et al. | |
| 5,504,507 A | | 4/1996 | Watrobski et al. | |
| 5,668,582 A | | 9/1997 | Manzone et al. | |
| 5,757,394 A | * | 5/1998 | Gibson et al. | 347/19 |
| 5,815,192 A | | 9/1998 | Matsuo et al. | |
| 5,831,649 A | | 11/1998 | Watrobski et al. | |
| 5,940,095 A | | 8/1999 | Parish et al. | |
| 6,022,094 A | | 2/2000 | Gibson et al. | |
| 6,126,266 A | | 10/2000 | Numata et al. | |
| 6,130,683 A | | 10/2000 | Ju | |
| 6,151,041 A | * | 11/2000 | Bolash et al. | 347/19 |
| 6,164,758 A | | 12/2000 | Kretschmer | |
| 2002/0126170 A1 | * | 9/2002 | Akama et al. | 347/19 |

FOREIGN PATENT DOCUMENTS

| | | |
|---|---|---|
| EP | 1 070 585 | 1/2001 |
| JP | 7237306 | 9/1995 |

* cited by examiner

*Primary Examiner*—Lamson Nguyen
*Assistant Examiner*—Blaise Mouttet
(74) *Attorney, Agent, or Firm*—Mark P. Crockett; Jacqueline M. Daspit

(57) ABSTRACT

An apparatus provides identification information related to at least one ink jet print head in an ink jet printer. The apparatus includes a printer controller for providing a first identification data string comprising n number of bits, at least one of which has a first state, and no more than n−1 number of which have a second state different from the first state. Coupled to the printer controller is a first ink jet print head having a first serial input shift register. The first serial input shift register has at least n number of bit positions for receiving the n number of bits of the first identification data string. The first ink jet print head also includes at least n number of first latches, each of which is coupled to a corresponding one of the n number of bit positions of the first shift register. The n number of first latches are for latching the n number of bits of the first identification data string from the n number of bit positions of the first shift register. A first identification line, which is coupled to a predetermined one of the first latches, provides to the printer controller one of the n number of bits from the first identification data string that is latched into the predetermined one of the first latches. Based upon whether the bit provided on the first identification line has a first or second state, the printer controller determines whether the first print head is of a first type.

16 Claims, 4 Drawing Sheets

INTEGRATED INK JET PRINT HEAD IDENTIFICATION SYSTEM

FIELD OF THE INVENTION

The present invention is generally directed to ink jet printers. More particularly, the invention is directed to identification of print heads installed in ink jet printers.

BACKGROUND OF THE INVENTION

Increasingly, ink jet printers in all price ranges provide multicolor printing capabilities. Typically, these printers include one print head for printing in black ink, and at least one other print head for printing in multiple colors of ink, such as magenta, cyan, and yellow. These print heads are usually replaceable and disposable, so that a new print head may be installed when the ink supply in the print head is depleted.

In many print head designs, the black and multicolor print heads are physically interchangeable, such that any type of print head may be installed in any available installation slot in the printer carriage. Since the format of print data provided to a black print head is generally different from the format of print data provided to a multicolor print head, the printer should be able to identify which type of print head is installed in each installation slot so that print data may be routed appropriately.

Prior techniques have been devised for storing print head identification information on a print head and for accessing that information to identify the type of print head installed in a particular carriage location. However, these prior techniques have required additional memory modules on the print head, and/or a significant number of additional input/output lines between the print head and the printer controller to implement the identification scheme. Such additional memory modules and input/output lines add significant additional complexity to the disposable print heads, thereby increasing their cost.

Therefore, a print head identification system is needed, the implementation of which requires a minimal number of input/output lines and no additional memory modules on the print head.

SUMMARY OF THE INVENTION

The foregoing and other needs are met by an apparatus for providing identification information related to at least one ink jet print head in an ink jet printer. In preferred embodiments, the apparatus includes a printer controller for providing a first identification data string comprising n number of bits, where at least one of the bits in the first identification data string has a first state, and no more than n−1 number of the bits in the first string have a second state different from the first state. Coupled to the printer controller is a first ink jet print head which includes a first serial input shift register. The first serial input shift register has at least n number of bit positions for receiving the n number of bits of the first identification data string from the printer controller. The first ink jet print head also includes at least n number of first latches, each of which is coupled to a corresponding one of the n number of bit positions of the first shift register. The n number of first latches are for latching the n number of bits of the first identification data string from the n number of bit positions of the first shift register. A first identification line is coupled to a predetermined one of the first latches and to the printer controller. The first identification line provides to the printer controller one of the n number of bits from the first identification data string that is latched into the predetermined one of the first latches. Based upon whether the bit provided on the first identification line has a first or second state, the printer controller determines whether the first print head is of a first type.

Preferably, the first serial input shift register is the same input shift register used to receive print data during normal printing operations. Thus, the present invention provides for identifying the type of print head installed without adding a significant amount of additional circuitry to the print head.

In another aspect, the invention provides an apparatus for providing identification information related to at least one ink jet print head having ink ejecting elements. The apparatus includes a printer controller that is operable in a normal print mode and in a print head identification mode. When in the print head identification mode, the printer controller provides at least one identification data string having n number of bits, where at least one of the bits in the identification data string has a first state, and no more than n−1 number of the bits in the identification data string have a second state different from the first state. When in the normal print mode, the printer controller provides a print data string having at least n−1 number of bits related to an image to be printed. Coupled to the printer controller is an ink jet print head. The ink jet print head preferably includes a serial input shift register having at least n number of bit positions for receiving the n number of bits of the identification data string or the n−1 number of bits of the print data string from the printer controller. The print head also has at least n number of latches, each of which is coupled to a corresponding one of the n number of bit positions of the shift register. The latches are for latching the n number of bits of the identification data string or the n−1 number of bits of the print data string from the n number of bit positions of the shift register. Selection logic circuitry in the print head receives the n−1 number of bits of the print data string from the n number of latches, and selects particular ink ejecting elements in the print head to be activated based at least in part on the n−1 number of bits of print data. The apparatus also includes an identification line coupled to a predetermined one of the latches and to the printer controller. The identification line provides to the printer controller one of the n number of bits from the identification data string that is latched into the predetermined one of the latches. Based upon whether the bit provided on the identification line has a first or second state, the printer controller determines whether the print head is of a particular type.

In yet another aspect, the invention provides a method for generating identification information related to at least one ink jet print head in an ink jet printer. The method includes the step of shifting a first identification data string into a first serial input shift register of a first print head, where the first identification data string has n number of bits. At least one of the bits in the first identification data string has a first state, and no more than n−1 number of the bits in the first string have a second state different from the first state. The method also includes the steps of latching the n number of bits of the first identification data string from the n number of bit positions of the first shift register into n number of corresponding first latches, and accessing one of the bits of the first identification data string from a predetermined one of the first latches. Based upon whether the bit accessed from the predetermined one of the first latches has a first or second state, a determination is made whether the first print head is of a first type.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
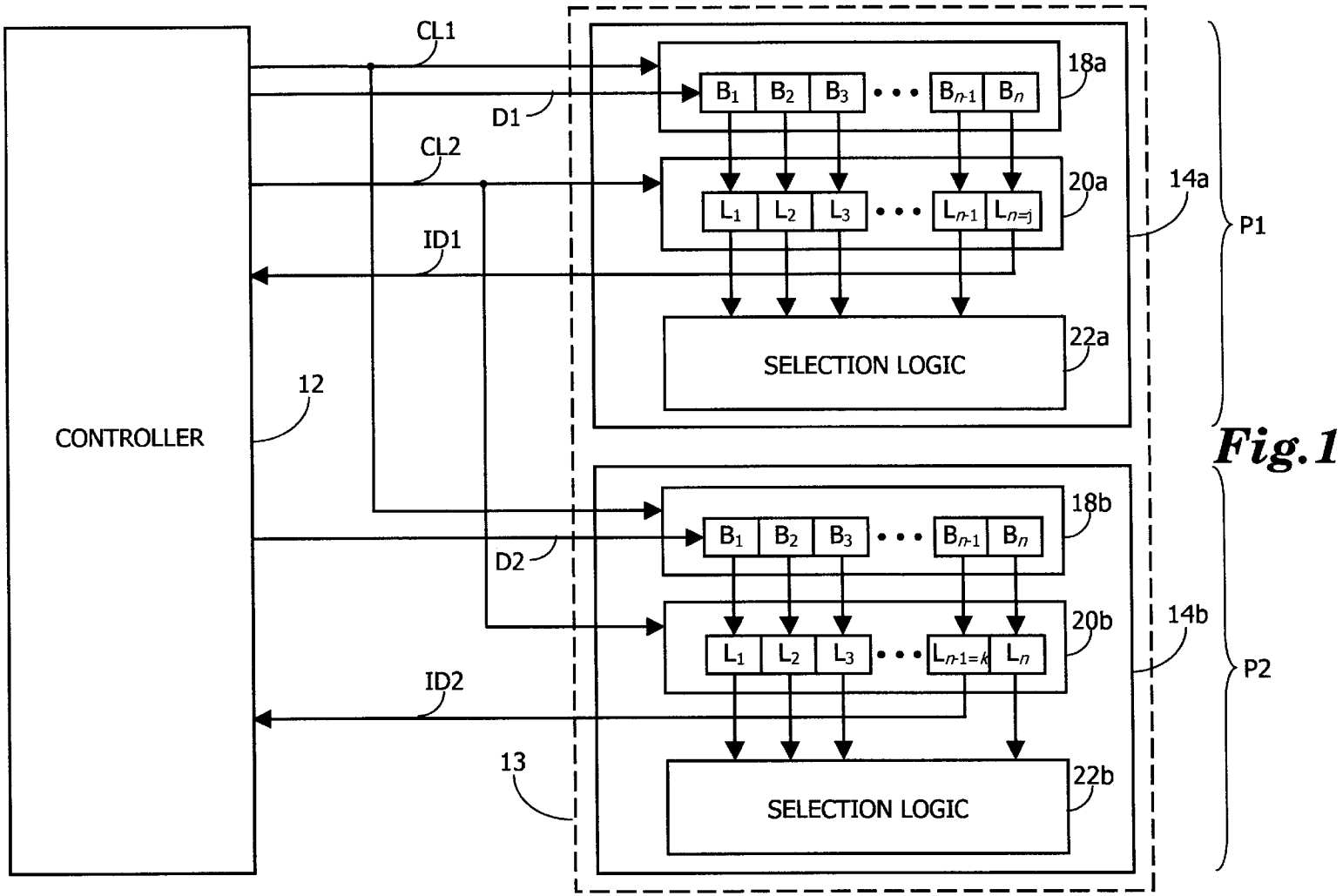
FIG. 1 is a functional block diagram of a print head identification system according to a preferred embodiment of the invention.

Depicted in FIG. 1 is an ink jet printer incorporating a print head identification system according to a preferred embodiment of the invention. The printer includes an application-specific integrated circuit (ASIC), also referred to herein as a printer controller 12, for providing control signals to print heads 14*a* and 14*b* installed in a printer carriage 13. Preferably, the print heads 14*a* and 14*b* are different types of print heads, such as for printing different colors of ink. For example, the print head 14*a* may be for printing in black ink only, while the print head 14*b* is for printing in cyan, magenta, and yellow inks. Alternatively, the print head 14*a* may be for printing in any single color of ink, and print head 14*b* may be for printing in any other single color of ink. Or, print heads 14*a* and 14*b* may both be single-color or multi-color print heads containing different types of ink for printing on different types of print media.

In preferred embodiments of the invention, the print heads 14*a* and 14*b* are replaceable and physically interchangeable in the carriage 13. Thus, if there are two print head installation locations P1 and P2 in the carriage 13, either print head 14*a* or 14*b* may be mounted in either location P1 or P2 in the carriage 13. Since the print heads 14*a* and 14*b* preferably are of different types, the printer controller 12 provides different types of control signals to the two print heads 14*a* and 14*b* for controlling their operation. As described in detail hereinafter, according to the preferred embodiment of the present invention, the controller 12 receives information from the print heads 14*a* and 14*b* indicative of whether either print head 14*a* or 14*b* is installed in either location P1 or P2, and if so, whether the print heads 14*a* and 14*b* are installed in their proper locations P1 and P2 for receiving the correct control signals. In an alternative embodiment, the controller 12 receives information from the print heads 14*a* and 14*b* indicative of the carriage locations P1 and P2 in which the print heads 14*a* and 14*b* are installed so that the controller 12 may route the control signals accordingly.

In the configuration shown in FIG. 1, the print head 14*a* is installed in the carriage location P1, and the print head 14*b* is installed in the carriage location P2. However, since the print heads 14*a* and 14*b* are physically interchangeable, it should be appreciated that the print head 14*a* could be installed in the carriage location P2, and the print head 14*b* could be installed in the carriage location P1.

As depicted in FIG. 1, the controller 12 is coupled to the print head 14*a* installed in the carriage location P1 by a serial data line D1, a shift clock line CL1, and a latch clock line CL2. The controller 12 is also coupled to the print head 14*b* installed in the carriage location P2 by a serial data line D2, the shift clock line CL1, and the latch clock line CL2. The print heads 14*a* and 14*b* include n-bit serial shift registers 18*a* and 18*b*, each having n number of bit locations $B_1$–$B_n$ for receiving n bits of data via the serial data lines D1 and D2, respectively. When the printer is operating in a normal print mode, the data provided on the lines D1 and D2 is print data, corresponding to images to be printed on a print medium. When the printer is operating in an identification mode, the data provided on the lines D1 and D2 is identification data, as discussed in more detail below. In either case, data is shifted into the bit locations $B_1$–$B_n$ of the shift registers 18*a* and 18*b* based on a shift clock signal on the shift clock line CL1.

As shown in FIG. 1, the print heads 14*a* and 14*b* preferably include latch circuits 20*a* and 20*b*, each having n number of latches $L_1$–$L_n$. In the preferred embodiment of the invention, n−1 number of the latches $L_1$–$L_n$ are coupled to n−1 number of the corresponding bit locations $B_1$–$B_n$, of the shift registers 18*a* and 18*b*. Based on a latch clock signal on the latch clock line CL2, the latch circuits 20*a* and 20*b* provide latched print data bits to selection logic circuits 22*a* and 22*b*. Based on the latched print data bits, the selection logic circuits 22*a–b* determine which ink jet nozzles are selected to eject ink to form the printed image.

As depicted in the preferred embodiment of FIG. 1, a latch $L_j$ of the latch circuit 20*a* is coupled to a first identification line ID1, and a latch $L_k$ of the latch circuit 20*b* is coupled to a second identification line ID2, where j is not equal to k. For example, as depicted in FIG. 1, the latch $L_n$ of the latch circuit 20*a* (j=n) is coupled to the identification line ID1, whereas the latch $L_{n-1}$ of the latch circuit 20*b* (k=n−1) is coupled to the identification line ID2. One skilled in the art will appreciate that in other embodiments other latches could be coupled to the identification lines ID1 and ID2, such as latch $L_1$ of latch circuit 20*a* (j=1) and latch $L_3$ of latch circuit 20*b* (k=3).

As shown in FIG. 1, the first and second identification lines ID1 and ID2 are coupled to the controller 12. As discussed in more detail below, the identification lines ID1 and ID2 feed identification bits from the print heads 14*a* and 14*b* back to the printer controller 12 to identify which print head 14*a* or 14*b* is installed in which carriage location P1 and P2.

Figure 2A:
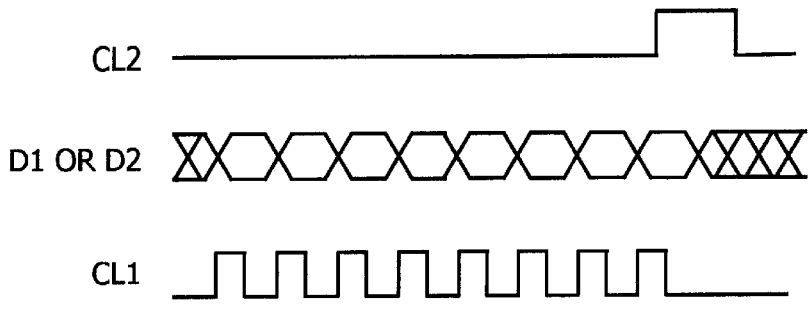
FIGS. 2A, 2B, and 2C are timing diagrams for a print head identification system according to a preferred embodiment of the invention.

Referring now to the timing diagrams of FIGS. 2A–C and the flow diagrams of FIGS. 3 and 4, the operation of preferred embodiments of the invention will be described. FIG. 2A depicts the operation of the printer in the normal printing mode, and FIGS. 2B, 2C, 3, and 4 depict operation in the identification mode.

As shown in FIG. 2A, print data on the print data lines D1 and D2 are shifted into the shift registers 18*a* and 18*b* based on the shift clock signal on the shift clock line CL1. The data bits are then latched into the latch circuits 20*a* and 20*b* based on the second clock signal on the latch clock line CL2. In the example of FIG. 2A, eight data bits (n=8) are shifted into eight bit positions $B_1$–$B_8$ based on eight clock pulses on the shift clock line CL1. Preferably, when the latch clock signal on the latch clock line CL2 goes high, the eight data bits are latched into the eight latches $L_1$–$L_8$.

When operating in the identification mode, an identification data string, preferably consisting of a single high data bit and n−1 number of low data bits, is provided to the print head 14*a* or 14*b* on the data line D1 or D2. If the position of the high bit in the identification data string corresponds to the position of the latch coupled to the identification line ID1 or ID2, the high bit is fed back to the controller 12 on the identification line ID1 or ID2. If the position of the high bit in the identification data string does not correspond to the position of the latch coupled to the identification line ID1 or ID2, a low bit is fed back to the controller 12 on the identification line ID1 or ID2. Also, if no print head is installed in the location P1 (or P2), then the identification line ID1 (or ID2) will be in a low state.

Figure 2B:
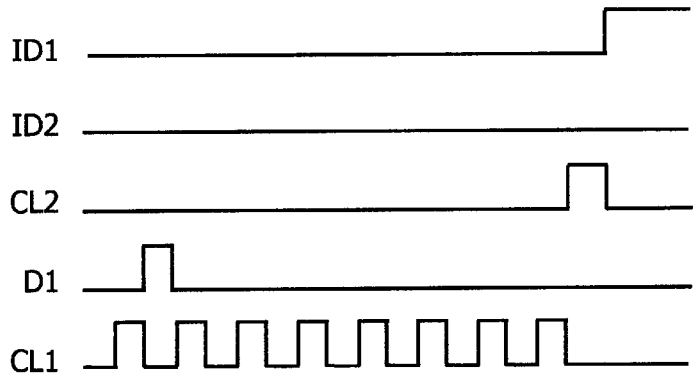
Figure 2C:
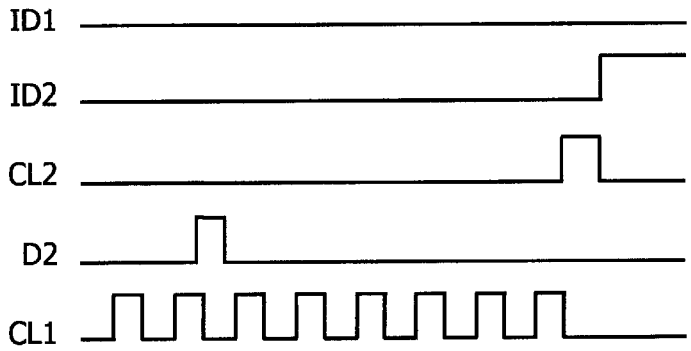
Figure 3:
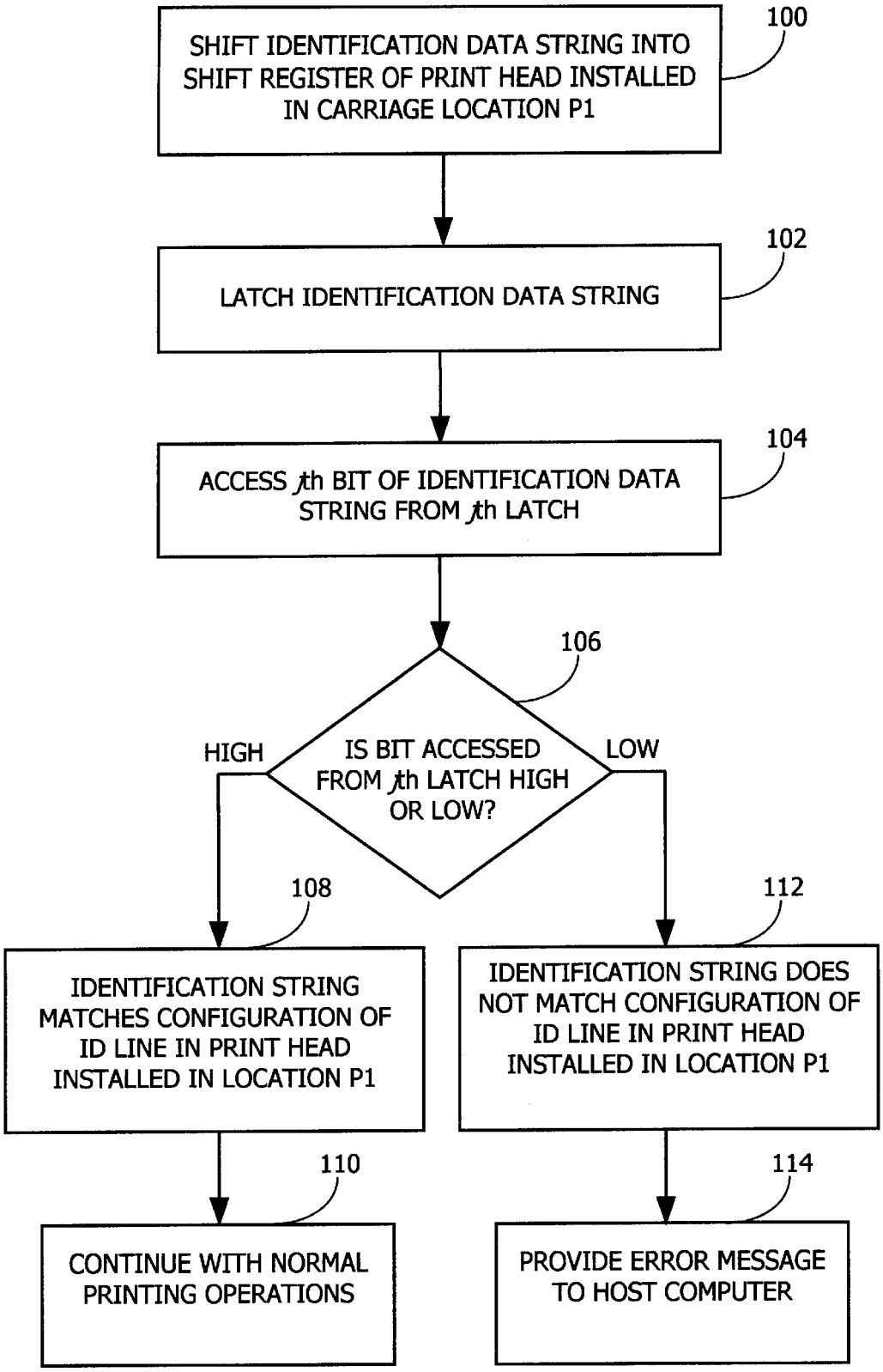
FIG. 3 is a flow diagram for identifying a first type of print head according to a preferred embodiment of the invention.
Figure 4:
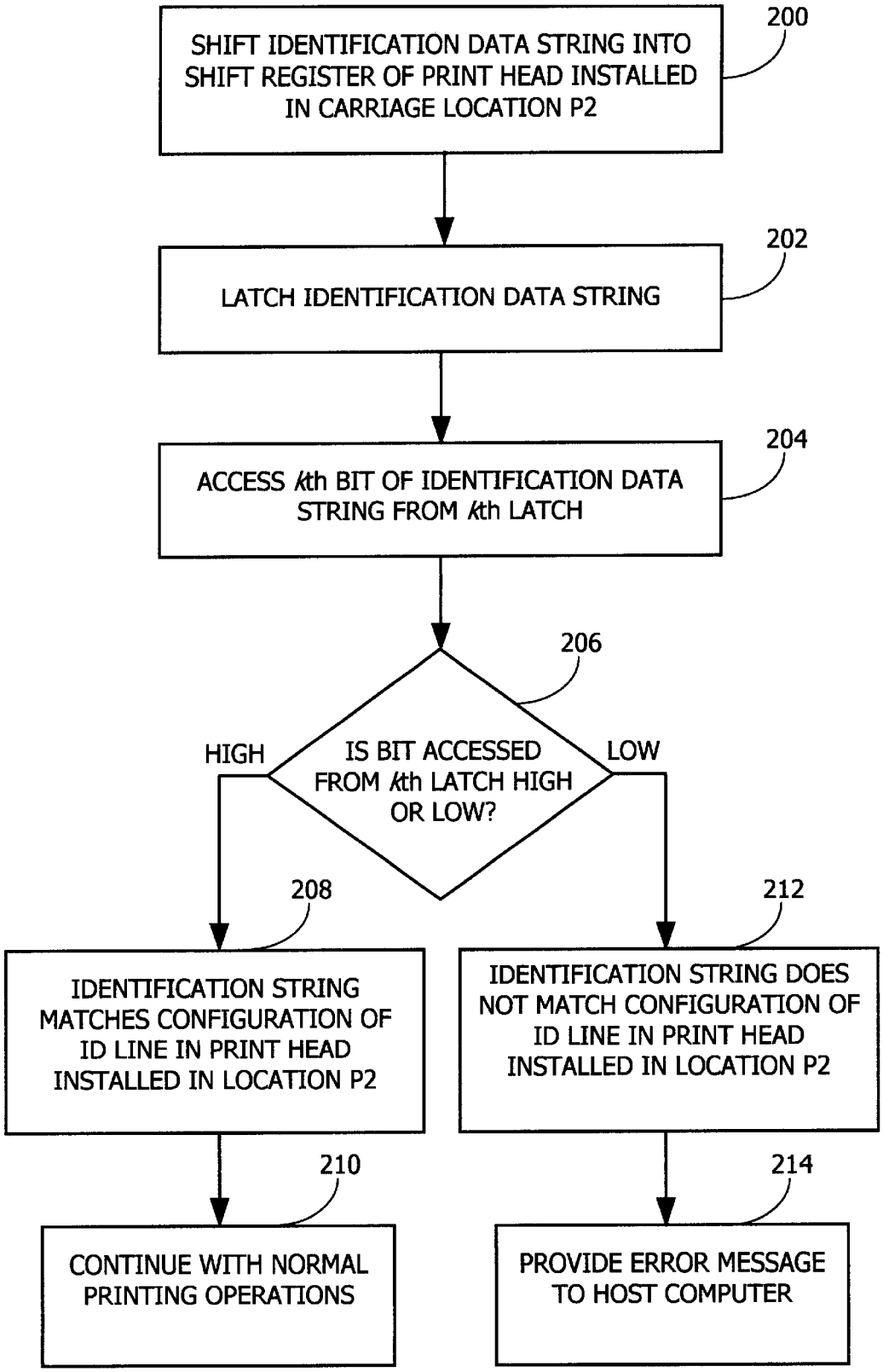
FIG. 4 is a flow diagram for identifying a second type of print head according to a preferred embodiment of the invention.

For example, consider the configuration of FIG. 1, the timing diagram of FIG. 2B, and the flow diagram of FIG. 3. An eight-bit identification string (n=8) having a high bit in the jth bit position (j=8) is shifted into the shift register 18*a* from the data line D1 (step 100). At the completion of eight clock pulses on the line CL1, the bit positions $B_1$–$B_8$ of the shift register 18*a* contain data as indicated in Table I. Preferably, on the falling edge of the latch clock signal on the line CL2, the bits in bit positions $B_1$–$B_8$ are latched into the latches $L_1$–$L_8$ (step 102), thereby putting a high bit in the latch $L_8$. Through the identification line ID1, the controller 12 accesses the high bit in the latch $L_8$ (step 104). Since the signal on the line ID1 is high (step 106), this indicates to the controller 12 that the bit position of the high bit in the identification data string on the line D1 matches the latch position ($L_8$) to which the identification line ID1 is connected (step 108). This match indicates to the controller 12 that the print head 14*a* is correctly installed in the carriage position P1, and that normal printing operations may continue (step 110).

TABLE I

| $B_1$ | $B_2$ | $B_3$ | $B_4$ | $B_5$ | $B_6$ | $B_7$ | $B_8$ |
|---|---|---|---|---|---|---|---|
| 0 | 0 | 0 | 0 | 0 | 0 | 0 | 1 |

Now consider the configuration of FIG. 1, the timing diagram of FIG. 2C, and the flow diagram of FIG. 4. An eight-bit identification string (n=8) having a high bit in the kth bit position (k=7) is shifted into the shift register 18*b* from the data line D2 (step 200). At the completion of eight clock pulses on the line CL2, the bit positions $B_1$–$B_8$ of the shift register 18*b* contain data as indicated in Table II. Preferably, on the falling edge of the latch clock signal on the line CL2, the bits in bit positions $B_1$–$B_8$ are latched into the latches $L_1$–$L_8$ (step 202), thereby putting a high bit in the latch $L_7$. Through the identification line ID2, the controller 12 accesses the high bit in the latch $L_7$ (step 204). Since the signal on the line ID2 is high (step 206), this indicates to the controller 12 that the bit position of the high bit in the identification data string on the line D2 matches the latch position ($L_7$) to which the identification line ID2 is connected (step 208). This match indicates to the controller 12 that the print head 14*b* is correctly installed in the carriage position P2, and that normal printing operations may continue (step 210).

TABLE II

| $B_1$ | $B_2$ | $B_3$ | $B_4$ | $B_5$ | $B_6$ | $B_7$ | $B_8$ |
|---|---|---|---|---|---|---|---|
| 0 | 0 | 0 | 0 | 0 | 0 | 1 | 0 |

Again consider the configuration of FIG. 1, the timing diagram of FIG. 2B, and the flow diagram of FIG. 4, this time shifting in an identification string (n=8) having a high bit in the jth bit position (j=8) into the shift register 18*b* (step 200). At the completion of eight clock pulses on the line CL1, the bit positions $B_1$–$B_8$ of the shift register 18*b* contain data as indicated in Table I. On the falling edge of the latch clock signal on the line CL2, the bits in bit positions $B_1$–$B_8$ are latched into the latches $L_1$–$L_8$ (step 202). In this situation, the controller 12 accesses a low bit in the latch $L_7$ of the print head 14*b* (step 204). If the signal on the line ID2 is low (step 206), this indicates to the controller 12 that the high bit position in the identification data string (j=8) on the line D2 does not match the latch position ($L_7$) fed back on the identification line ID2 (step 212). In this case, the printer controller 12 preferably provides an error flag or message to the host computer (step 214).

Finally, consider the configuration of FIG. 1, the timing diagram of FIG. 2C, and the flow diagram of FIG. 3, this time shifting in an identification string (n=8) having a high bit in the kth bit position (k=7) into the shift register 18*a* (step 100). At the completion of eight clock pulses on the line CL1, the bit positions $B_1$–$B_8$ of the shift register 18*a* contain data as indicated in Table II. On the falling edge of the latch clock signal on the line CL2, the bits in bit positions $B_1$–$B_8$ are latched into the latches $L_1$–$L_8$ (step 102). In this situation, the controller 12 accesses a low bit in the latch $L_8$ of the print head 14*a* (step 104). If the signal on the line ID1 is low (step 106), this indicates to the controller 12 that the high bit position in the identification data string (k=7) on the line D1 does not match the latch position ($L_8$) fed back on the identification line ID1 (step 112). In this case, the printer controller 12 preferably provides an error flag or message to the host computer (step 114).

When a mismatch occurs, the printer controller 12 may react in several different ways. For example, consider a situation in which the controller 12 sends an identification string corresponding to a black print head to a particular print head position, and a mismatch occurs because a color print head is installed in that position. In a preferred embodiment of the invention, the controller 12 in such situation generates a mismatch signal which is provided to a host computer connected to the printer. Based on the mismatch signal, software running on the host computer may generate a message such as, "Error: an incorrect type of print head, or no print head, is installed in the black print head position." In an alternative embodiment, upon detection of a mismatch, the controller 12 sends an identification string corresponding to a color print head to the same position. If a match then results, the controller 12 adjusts its operation to provide color print data to the print head installed in that position.

One skilled in the art will appreciate that there are many other possible ways for the printer controller 12 to react to a mismatch condition, and the scope of the invention is not limited to any particular reaction of the controller 12 to a mismatch.

One skilled in the art will also appreciate that the invention may be used to identify as many different types of print heads are there are bit positions $B_1$–$B_n$, in the shift registers 18*a* or 18*b*, since the identification data line ID1 or ID2 could be coupled to any of the latches $L_1$–$L_n$, so long as j does not equal k. It will also be appreciated that the invention is applicable to identifying print heads in more than two print head installation locations in a printer carriage.

If no print head is installed in the carriage location P1, then it will be appreciated that no high bit will be present on the identification line ID1. Similarly, if no print head is installed in the carriage location P2, then no high bit will be present on the identification line ID2. In these situations, the printer controller 12 preferably provides an error flag or message to the host computer.

It is contemplated, and will be apparent to those skilled in the art from the preceding description and the accompanying drawings that modifications and/or changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. An apparatus for providing identification information related to at least one ink jet print head in an ink jet printer, the apparatus comprising:

a printer controller for providing a first identification data string comprising n number of bits, where at least one of the bits in the first identification data string has a first state, and no more than n−1 number of the bits in the first string have a second state different from the first state;

a first ink jet print head coupled to the printer controller, the first ink jet print head comprising:

a first serial input shift register having at least n number of bit positions for receiving the n number of bits of the first identification data string from the printer controller; and at least n number of first latches, each first latch coupled to a corresponding one of the n number of bit positions of the first shift register for latching the n number of bits of the first identification data string from the n number of bit positions of the first shift register;

a first identification line coupled to a predetermined one of the first latches and to the printer controller, the first identification line for providing to the printer controller one of the n number of bits from the first identification data string that is latched into the predetermined one of the first latches; and the printer controller further for determining, based upon whether the bit provided on the first identification line has a first or second state, whether the first print head is of a first type.

2. The apparatus of claim 1 further comprising:

the printer controller for providing the first identification data string wherein a bit having the first state is in a jth bit position in the first identification data string, where j is less than or equal to n, and the no more than n−1 number of the bits having the second state are in bit positions in the first identification data string other than the jth bit position;

the first serial input shift register having a jth bit position for receiving the bit having the first state in the jth bit position of the first identification data string;

the at least n number of first latches including a jth first latch coupled to the jth bit position of the first shift register, the jth first latch for latching the bit having the first state from the jth bit position of the first shift register;

the first identification line coupled to the jth first latch for providing to the printer controller the bit having the first state that is latched into the jth first latch; and the printer controller further for determining, based upon the bit having the first state provided on the first identification line, that the first print head is of the first type.

3. The apparatus of claim 2 further comprising:

the printer controller for providing a second identification data string comprising n number of bits, wherein a bit having the second state is in the jth bit position;

the jth bit position of the first serial input shift register for receiving from the printer controller the bit having the second state in the second identification data string;

the jth first latch for latching the bit having the second state from the jth bit position of the first shift register;

the first identification line for providing to the printer controller the bit having the second state that is latched into the jth first latch; and the printer controller further for determining, based upon the bit having the second state provided on the first identification line, that the first print head is not of the first type.

4. The apparatus of claim 1 further comprising:

the printer controller for providing a second identification data string comprising n number of bits, where at least one of the bits in the second identification data string has the first state, and no more than n−1 number of the bits in the second string have the second state;

a second ink jet print head coupled to the printer controller, the second ink jet print head comprising:

a second serial input shift register having at least n number of bit positions for receiving the n number of bits of the second identification data string from the printer controller;

at least n number of second latches, each second latch coupled to a corresponding one of the n number of bit positions of the second shift register for latching the n number of bits of the second identification data string from the n number of bit positions of the second shift register;

a second identification line coupled to the printer controller and to a predetermined one of the second latches corresponding to a bit position different from the bit position of the predetermined one of the first latches to which the first identification line is coupled, the second identification line for providing to the printer controller one of the n number of bits from the second identification data string that is latched into the predetermined one of the second latches; and the printer controller further for determining, based upon whether the bit provided on the second identification line has a first or second state, whether the second print head is of a second type which is different from the first type.

5. The apparatus of claim 4 further comprising:

the printer controller for providing the second identification data string wherein a bit having the first state is in a kth bit position in the second identification data string, where k is less than or equal to n, and the no more than n−1 number of the bits having the second state are in bit positions in the first identification data string other than the kth bit position;

the second serial input shift register having a kth bit position for receiving the bit having the first state in the kth bit position of the second identification data string;

the at least n number of second latches including a kth second latch coupled to the kth bit position of the second shift register, the kth second latch for latching the bit having the first state from the kth bit position of the second shift register;

the second identification line coupled to the kth second latch for providing to the printer controller the bit having the first state that is latched into the kth second latch; and the printer controller further for determining, based upon the bit having the first state provided on the second identification line, that the second print head is of the second type.

6. The apparatus of claim 5 further comprising:

the printer controller for providing a third identification data string comprising n number of bits, wherein a bit having the second state is in the kth bit position;

the kth bit position of the second serial input shift register for receiving from the printer controller the bit having the second state in the third identification data string;

the kth second latch for latching the bit having the second state from the kth bit position of the second shift register;

the second identification line for providing to the printer controller the bit having the second state that is latched into the kth second latch; and the printer controller further for determining, based upon the bit having the second state provided on the second identification line, that the second print head is not of the second type.

7. An apparatus for providing identification information related to at least one ink jet print head in an ink jet printer, the apparatus comprising:

a printer controller for providing a first identification data string comprising n number of bits, where a jth bit position of the n number of bit positions in the first identification data string has a first state, and where n−1 number of other bit positions in the first identification data string have a second state different from the first state, the first identification data string for identifying an ink jet print head of a first type, the printer controller further for providing a second identification data string comprising n number of bits, where a kth bit position of the n number of bit positions in the second identification data string has a first state, where n−1 number of other bit positions in the second identification data string have a second state different from the first state, where k is not equal to j, the second identification data string for identifying an ink jet print head of a second type;

a first ink jet print head coupled to the printer controller, the first ink jet print head comprising:

a first serial input shift register having at least n number of bit positions for receiving the n number of bits of the first identification data string from the printer controller, where one of the bit positions is a jth bit position for receiving from the printer controller the bit of the first identification data string having the first state; and at least n number of first latches, each first latch coupled to a corresponding one of the n number of bit positions of the first shift register for latching the n number of bits of the first identification data string from the n number of bit positions of the first shift register, where the at least n number of first latches include a jth first latch coupled to the jth bit position of the first shift register, the jth first latch for latching the bit having the first state from the jth bit position of the first shift register;

a first identification line coupled to the jth first latch for providing to the printer controller the bit having the first state that is latched into the jth first latch;

a second ink jet print head coupled to the printer controller, the second ink jet print head comprising:

a second serial input shift register having at least n number of bit positions for receiving the n number of bits of the second identification data string from the printer controller, where one of the bit positions is a kth bit position for receiving from the printer controller the bit of the second identification data string having the first state; and at least n number of second latches, each second latch coupled to a corresponding one of the n number of bit positions of the second shift register for latching the n number of bits of the second identification data string from the n number of bit positions of the second shift register, where the at least n number of second latches include a kth second latch coupled to the kth bit position of the second shift register, the kth second latch for latching the bit having the first state from the kth bit position of the second shift register;

a second identification line coupled to the kth second latch for providing to the printer controller the bit having the first state that is latched into the kth second latch; and the printer controller for determining, based upon the bit having the first state provided on the first identification line, that the first print head is of the first type, and for determining, based upon the bit having the first state provided on the second identification line, that the second print head is of the second type.

8. The apparatus of claim 7 further comprising:

the printer controller for providing a third identification data string comprising n number of bits, at least one of which has the first state and no more than n−1 number of which have the second state, wherein a bit having the first state in the third identification data string is in a bit position other than the jth bit position, the third identification data string for identifying an ink jet print head of a type other than the first type;

the first serial input shift register for receiving the n number of bits of the third identification data string from the printer controller, where the jth bit position of the first serial input shift register receives a bit having the second state in the third identification data string;

the jth first latch for latching the bit having the second state from the jth bit position of the first shift register;

the first identification line for providing to the printer controller the bit having the second state that is latched into the jth first latch; and the printer controller further for determining, based upon the bit having the second state provided on the first identification line, that the first print head is not of the first type.

9. The apparatus of claim 8 where the third identification data string is the same as the second identification data string.

10. The apparatus of claim 7 further comprising:

the printer controller for providing a third identification data string comprising n number of bits, at least one of which has the first state and no more than n−1 number of which have the second state, wherein a bit having the first state in the third identification data string is in a bit position other than the kth bit position, the third identification data string for identifying an ink jet print head of a type other than the second type;

the second serial input shift register for receiving the n number of bits of the fourth identification data string from the printer controller, where the kth bit position of the second serial input shift register receives a bit having the second state in the third identification data string;

the kth second latch for latching the bit having the second state from the kth bit position of the second shift register;

the second identification line for providing to the printer controller the bit having the second state that is latched into the kth second latch; and the printer controller further for determining, based upon the bit having the second state provided on the second identification line, that the second print head is not of the second type.

11. The apparatus of claim 10 where the third identification data string is the same as the first identification data string.

12. An apparatus for providing identification information related to at least one ink jet print head having ink ejecting elements, the apparatus comprising:

a printer controller operable in a normal print mode and in a print head identification mode, when in the print head identification mode, the printer controller providing at least one identification data string comprising n number of bits, where at least one of the bits in the identification data string has a first state, and no more than n−1 number of the bits in the identification data string have a second state different from the first state, and when in the normal print mode, the printer controller providing a print data string comprising at least n−1 number of bits related to an image to be printed;

an ink jet print head coupled to the printer controller, the ink jet print head comprising:

a serial input shift register having at least n number of bit positions for receiving the n number of bits of the identification data string or the at least n−1 number of bits of the print data string from the printer controller;

at least n number of latches, each latch coupled to a corresponding one of the n number of bit positions of the shift register for latching the n number of bits of the identification data string or the at least n−1 number of bits of the print data string from the n number of bit positions of the shift register;

selection logic circuitry for receiving the at least n−1 number of bits of the print data string from the at least n number of latches, and for selecting particular ink ejecting elements in the print head to be activated based at least in part on the at least n−1 number of bits of print data;

an identification line coupled to a predetermined one of the latches and to the printer controller, the identification line for providing to the printer controller one of the n number of bits from the identification data string that is latched into the predetermined one of the latches; and the printer controller further for determining, based upon whether the bit provided on the identification line has a first or second state, whether the print head is of a particular type.

13. A method for generating identification information related to at least one ink jet print head in an ink jet printer, the method comprising:

(a) shifting a first identification data string into a first serial input shift register of a first print head, the first identification data string comprising n number of bits, where at least one of the bits in the first identification data string has a first state, and no more than n−1 number of the bits in the first string have a second state different from the first state;

(b) latching the n number of bits of the first identification data string from the n number of bit positions of the first shift register into n number of corresponding first latches;

(c) accessing one of the bits of the first identification data string from a predetermined one of the first latches; and (d) determining, based upon whether the bit accessed from the predetermined one of the first latches has a first or second state, whether the first print head is of a first type.

14. The method of claim 13 further comprising:

step (a) further comprising shifting the bit having the first state into a jth bit position of the first serial input shift register, and shifting the n−1 number of the bits having the second state into bit positions in the first serial input shift register other than the jth bit position;

step (b) further comprising latching the bit having the first state from the jth bit position of the first shift register into a jth first latch coupled to the jth bit position of the first shift register;

step (c) further comprising accessing the jth bit of the first identification data string from the jth first latch; and step (d) further comprising determining, based upon the jth bit of the first identification data string accessed from the jth first latch, whether the first print head is of the first type.

15. An method of claim 13 further comprising:

(e) shifting a second identification data string into a second serial input shift register of a second print head, the second identification data string comprising n number of bits, where at least one of the bits in the second identification data string has a first state, and no more than n−1 number of the bits in the second string have a second state different from the first state;

(f) latching the n number of bits of the second identification data string from the n number of bit positions of the second shift register into n number of corresponding second latches;

(g) accessing one of the bits of the second identification data string from a predetermined one of the second latches; and (h) determining, based upon whether the bit accessed from the predetermined one of the second latches has a first or second state, whether the second print head is of a second type.

16. The method of claim 15 further comprising:

step (e) further comprising shifting the bit having the first state into a kth bit position of the second serial input shift register, and shifting the n−1 number of the bits having the second state into bit positions in the second serial input shift register other than the kth bit position;

step (f) further comprising latching the bit having the first state from the kth bit position of the second shift register into a kth second latch coupled to the kth bit position of the second shift register;

step (g) further comprising accessing the kth bit of the second identification data string from the kth second latch; and step (h) further comprising determining, based upon the kth bit of the second identification data string accessed from the kth first latch, whether the second print head is of the second type.

* * * * *